United States Patent [19]

Miller

[11] 4,416,378

[45] Nov. 22, 1983

[54] STATIC DIVERTER MODULE

[76] Inventor: Gregory E. Miller, 1661 Felicita La., Escondido, Calif. 92025

[21] Appl. No.: 211,024

[22] Filed: Dec. 1, 1980

[51] Int. Cl.[3] ..... B07C 5/00; B65H 5/00

[52] U.S. Cl. ..... 209/583; 209/534; 271/225; 271/184; 271/DIG. 9

[58] Field of Search ..... 209/534, 583, 584, 657, 209/509; 194/4 C; 271/225, 184, DIG. 9, 273, 274; 232/8

[56] References Cited

U.S. PATENT DOCUMENTS

| | | | |
|---|---|---|---|
| 3,706,374 | 12/1972 | Ptacek | 209/534 |
| 3,765,523 | 10/1973 | Nakanishi | 209/534 |
| 3,850,299 | 11/1974 | Kreitzer | 209/534 |
| 3,929,327 | 12/1975 | Olson | 271/250 |
| 3,997,044 | 12/1976 | Schasser | 194/4 C |
| 4,251,000 | 2/1981 | Templeton | 209/657 |
| 4,318,484 | 3/1982 | Stiernspetz | 209/534 |

*Primary Examiner*—Allen N. Knowles

[57] ABSTRACT

A ticket diverter module for placement in a ticket handling system includes a housing having a transport passage and a capture passage intersecting the transport passage and includes a diverter member for diverting a ticket from the main transport passage into the capture passage in response to a selective directional movement of the ticket.

12 Claims, 6 Drawing Figures

STATIC DIVERTER MODULE

REFERENCE TO RELATED APPLICATIONS

The present application is directed to a modular unit that is part of a system covered by co-pending application entitled "Modularized Ticket Handling System For Use In Automatic Ticket Processing System", by John B. Roes et al and filed concurrently herewith.

BACKGROUND OF THE INVENTION

The present invention relates to ticket handling systems and pertains particularly to a ticket diverter module for such systems.

Automated ticket handling systems are becoming more prevalent throughout the world today. Such ticket handling systems are useful in conjunction with transportation systems, entertainment and sporting events, and banking and other similar operations.

The utilization of automated equipment is becoming more popular in order to reduce labor costs involved in ticketing and the like, and to reduce losses due to theft and pilferage. In order to be feasible, such automated ticketing systems must be highly reliable, durable and easily repaired. The approach of the present invention to the problem of reliability and easy repair is the construction of systems in modular units that are quickly and easily removable and replaceable within the system. This approach is to separate the various functions involved in the system into separate and distinct functions performed by separate and distinct modular units. This quickly and easily isolates functional failures into modular units which can be quickly and easily removed and replaced to quickly correct the functional problem.

It is also desirable that such units be as simple and inexpensive as possible.

SUMMARY AND OBJECTS OF THE INVENTION

It is the primary object of the present invention to provide an improved diverter module for a ticket handling system.

In accordance with the primary aspect of the present invention a diverter module for ticket handling systems includes a ticket transport passage with drive means for transporting a ticket between units in a system and including a capture passage for diverting the ticket from the transport passage in response to a predetermined signal.

BRIEF DESCRIPTION OF THE DRAWINGS

The above and other objects and advantages of the present invention will become apparent from the following description when read in conjunction with the drawings, wherein.

DETAILED DESCRIPTION OF A PREFERRED EMBODIMENT

Figure 1:
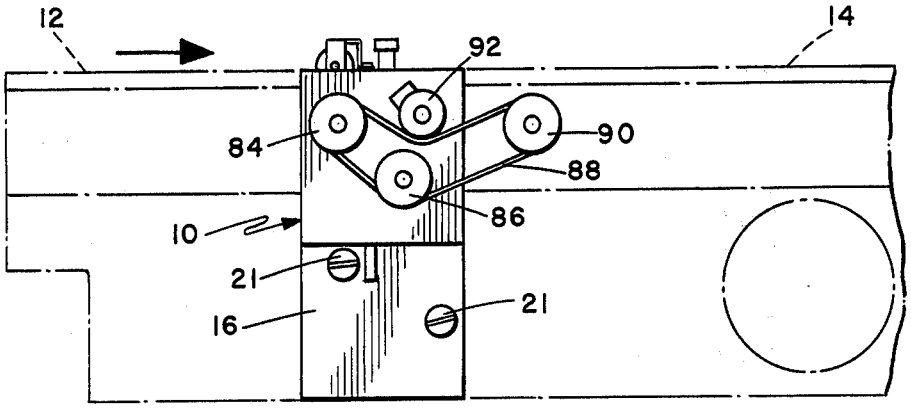
FIG. 1 illustrates the diverter positioned between a printer module and a ticket transport module.

Turning to FIG. 1 of the drawings there is illustrated a portion of a ticket handling and/or processing system wherein a diverter unit designated generally by the numeral 10 is disposed between a printing unit or module 12 and a transport unit or module 14. This shows a typical positioning of a diverter unit in a typical system. However, it should be understood that the diverter unit may be positioned at various positions within a system and in cooperative relationship with various units or modules of a system. It should be understood that the term "ticket" should not be limited in the conventional sense, but also extends to other items such as cards, scrip, and the like used as a medium of exchange.

The primary function of the present unit is to provide an alternate route for placement of a ticket such as the rejection of an invalid or unverified ticket from the ticket preparation system.

The normal path of the ticket in the illustrated system is shown by the arrow in FIG. 1 with the ticket passing from the printing module through the diverter module into the transport module.

Figure 2:
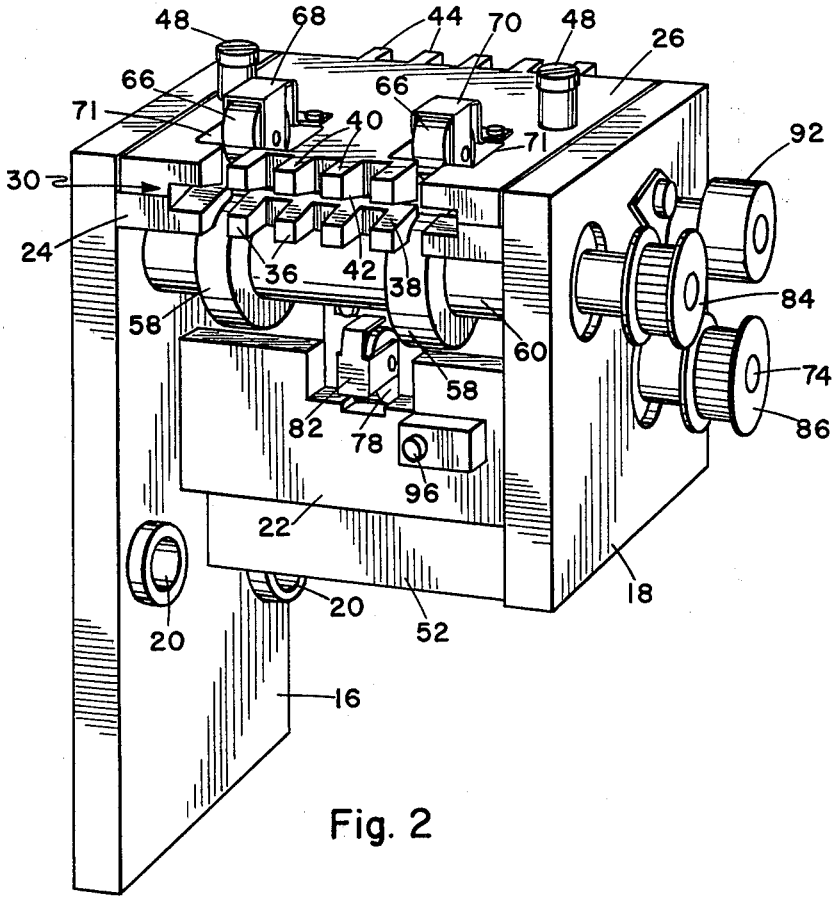
FIG. 2 is a perspective view of the diverter module from the ticket entry end.
Figure 3:
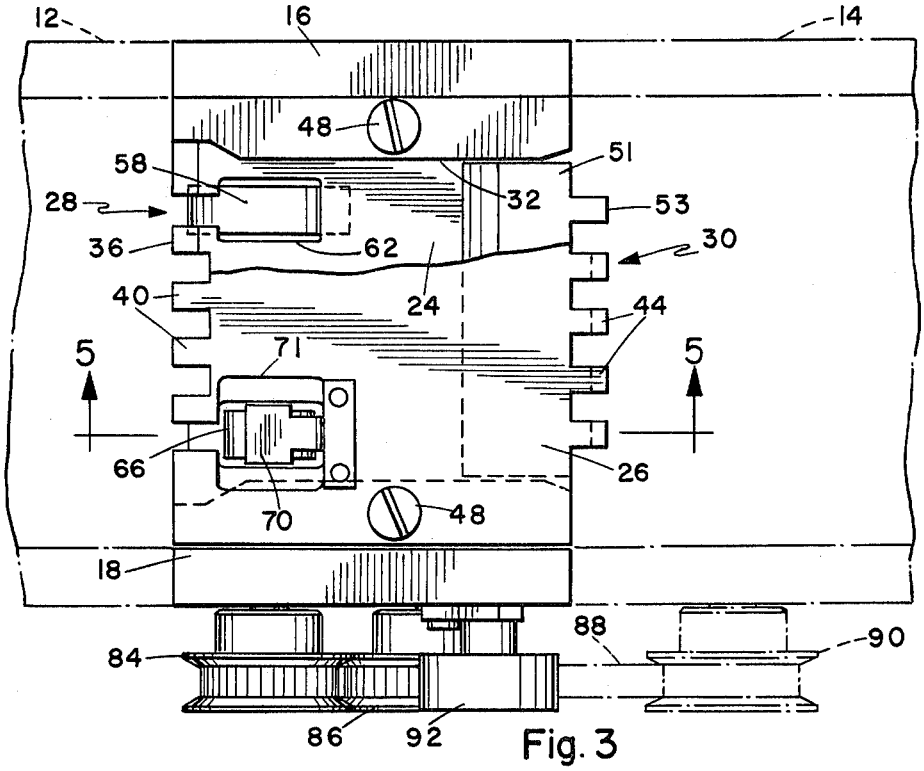
FIG. 3 is a top plan view of the diverter module.
Figure 4:
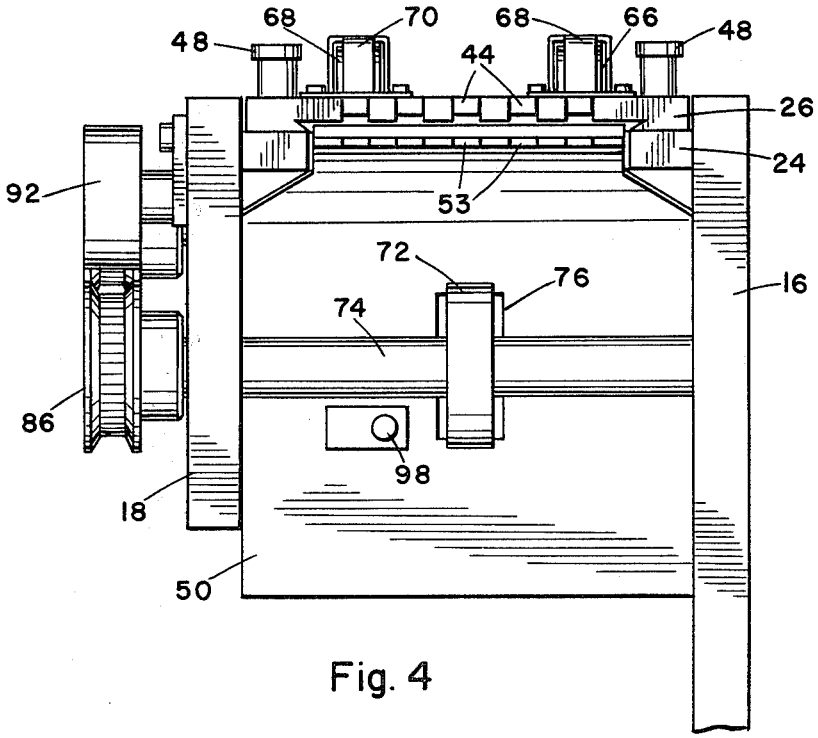
FIG. 4 is an end view from the ticket exit end of the module.

Turning more particularly to FIGS. 1 and 2 of the drawings, the unit comprises a housing comprising a base or end mounting plate 16 and an outer end plate 18. The mounting or base plate 16 includes a pair of mounting holes or apertures 20 for receiving and detachably mounting the unit to a mounting plate by means of quick release screws 21 or the like. This permits the unit to be quickly and easily mounted to a common mounting frame or panel of the system.

Figure 5:
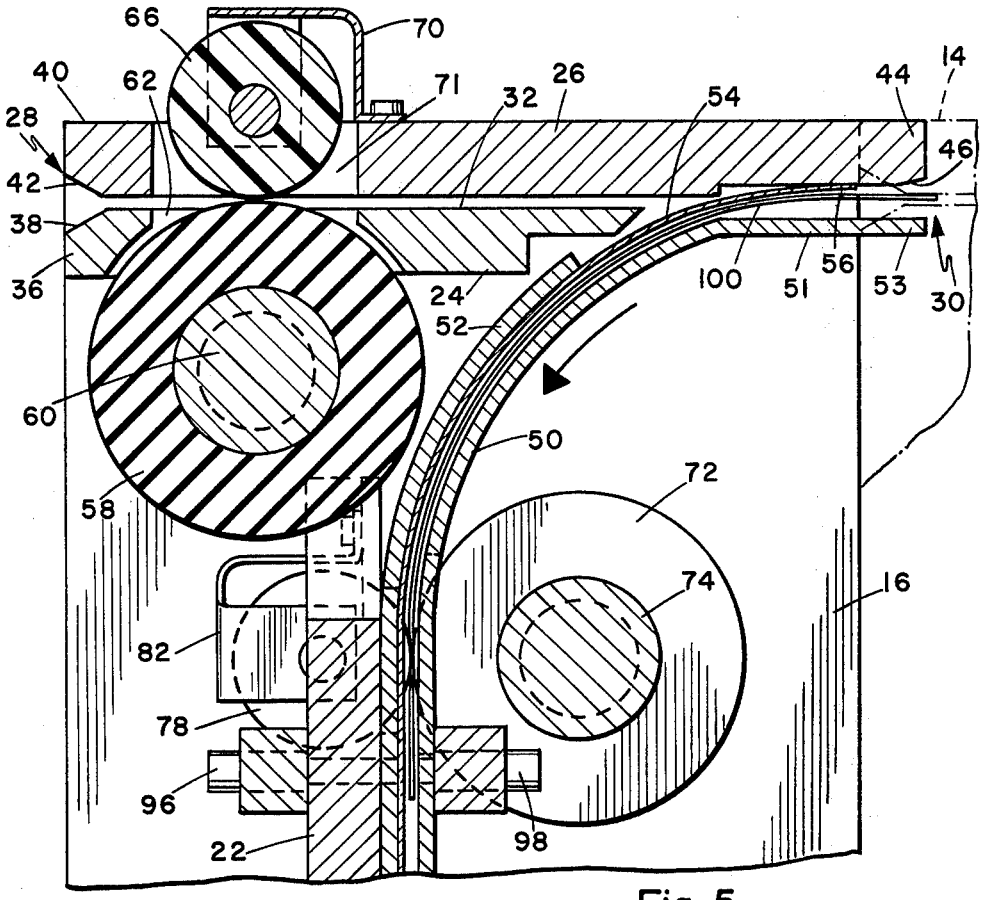
FIG. 5 is an enlarged sectional view taken on line 5—5 of FIG. 3, showing the return and diversion of a rejected ticket.

The housing further includes a side member 22 extending between the end plates 18 and 16 and a pair of closely spaced horizontally extending plates comprising a lower plate 24 and an upper plate 26. These upper and lower plates 24 and 26 are formed to define a primary outlet or secondary inlet 30 as best seen in FIG. 5. This primary transport passage 32 is formed by a groove which may be formed in either one or both of the respective plates, but is preferably formed such as a slot or groove formed in the lower plate 24. The plates 24, 26 are disposed in opposed relationship to confine the slot to form the passage 32 of a predetermined size, such as width and depth to receive and permit the passage of tickets of a predetermined size therethrough.

The lower plate 24 is or terminates short of the outlet end of the upper plate 26 and permits the intersection of a capture passage and diverter member with the primary transport passage 32, as will be described. The lower plate 24 at its entrance end includes a plurality of finger members 36 and a bevelled entry surface 38, which facilitates the interconnection of the unit with an adjacent unit having a corresponding passageway. This permits the interconnection of the passageways of adjacent units without the problem of tickets hanging up on misaligned edges or surfaces.

The upper plate 26 is similarly provided at the inlet with a plurality of finger members 40 and corresponding bevelled surfaces 42, with the outlet end thereof provided with similar finger members 44 and similar tapered surfaces 46. This provides and permits an interface with an adjacent adjoining unit having a similar passageway and permits misalignment of the passageway but still passage of tickets between the respective passageways of the respective units without jamming against the various edges.

The lower plate 24 is preferably fixed between the two end plates 16 and 18 in a suitable manner such as by bolting or the like (not shown) and the upper plate 26 is detachably secured to the lower plate 24 by a pair of screws 48 which preferably include spring means, not shown, for biasing the plate into contact with the lower plate 24. With this arrangement, the upper plate essentially floats to a degree on top of the lower plate, however with a firm engagement thereof.

Turning to FIG. 5, the device includes a passage 34 which is defined by a pair of spaced apart curved plate members 50 and 52 which intersect at the upper end tangentially with the main transport passage 32. Plate 50 includes a flat portion 51 that forms a planar, horizontal extension of the primary transport passage 32. These plates are spaced apart and curve into intersecting cooperation with the primary transport passage and curve downward such that the lower end of the capture passage 34 is presented in a position for dumping tickets into a suitable container or the like. The lower plate 50 includes at the forward end of flat portion 51 a plurality of finger like members 53 that cooperatively engage with fingers of the passage of an adjacent modular unit for guidance of tickets thereto. A diverter member 54 in the form of an elongated leaf spring extends from plate member 52 and has a forward end 56 which engages the underside of top plate 26 just inwardly of fingers 44. The diverter member 54 may be secured to the inside surface of the guide or plate member 52.

Figure 6:
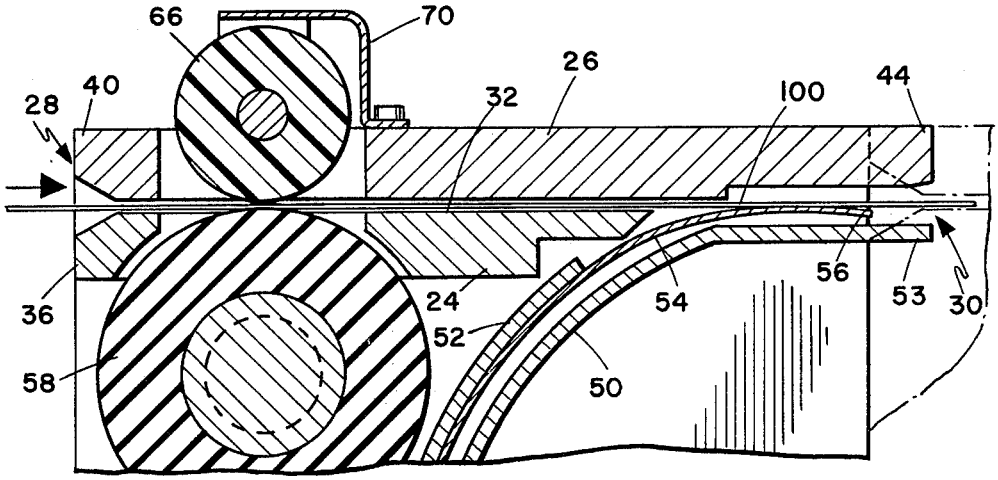
FIG. 6 is a similar sectional view showing the normally through passage of a ticket.

The transport means for the primary transport passage 32 comprises a pair of rollers 58 mounted on a drive shaft 60 which is journaled in bearings in the plates 16 and 18. These rollers extend through openings such as opening 62 as shown in the lower plate 24, (FIG. 5) and are engaged on the surface by a pair of pinch rollers 66, which are mounted on spring biasing bracket 68 and 70 and extend through holes or openings 71 in the upper plate 26. Thus, a ticket passing along the transport passage 32 extends between and is pinched between the rollers as shown in FIG. 6, and driven by the rollers through the transport passage and out the exit opening 30 into the next modular unit. The ticket engages the upper surface of the diverter member 54 near the end 56, biasing it downward to permit passage of the ticket to the outlet 30.

The drive or transport drive means for the capture passage 34 includes a roller 72 mounted on a shaft 74 which in turn is mounted or journaled in bearings in plates 16 and 18. The roller 72 extends through an aperture or opening 76 in the plate or guide member 50 and is engaged by a pinch roller 78 extending through an opening in the plate 52 and mounted or carried by a spring bracket member 82. Thus, a ticket extends down and between rollers 72 and 78 and is engaged thereby and driven downward through the capture passage 34 to the exit therefrom. The rollers are driven by drive means as shown in FIG. 1 including a pair of drive pulleys 84 and 86 mounted respectively on the drive shafts 60 and 74 and which are driven by a belt 88 by drive means 90 from unit 14. The drive means 90 is reversible for purposes as will be explained. An idler pulley or wheel 92 may be utilized to adjust and maintain tension in the belt 88.

Sensing means such as light beam sensors 96 and 98 are disposed in the capture passage 32 and is operative to sense the presence or passage of a ticket therebetween. This can be utilized in conjunction with other control elements to control the drive to position a ticket in a desired location or simply to detect or confirm the passage of the ticket. In certain systems or operations a ticket may be held in escrow within the capture passage for a predetermined time or event.

In operation of the device, a ticket 100 passes into the inlet end from a source such as the printer 12 and passes along the primary transport passageway, as in FIG. 6, to a subsequent unit 14 where the ticket may be examined or cancelled, or other appropriate action taken. The ticket then may pass from the unit 14 to the next unit or be disposed to a patron. Alternatively, should the ticket be improper or other disposition of the ticket be required, the ticket is fed backward from the unit 14 by reversal or drive means 90 into the secondary inlet 30 and is engaged by the diverter member 54, as in FIG. 5, forcing the ticket to pass downward along the capture passage 34 and either be held in position for a predetermined period of time or deposited in some receptacle beyond the diverter passage.

This diverter unit or module as above described can be used in many different systems or in different positions in a given system. The unit can for example be used primarily as an escrow unit with the outlet end 30 serving as inlet from another unit simply for receiving and/or temporarily holding tickets for confirmation, etc.

The unit is adapted to be quickly and easily removed and replaced in a system. The unit is also simple, rugged, and easily repaired.

Thus, while I have illustrated and described my invention by means of specific embodiments, it is to be understood that numerous changes and modifications may be made therein without departing from the spirit and scope of the invention as defined in the appended claims.

I claim:

1. A diverter unit for a ticket handling system, said unit comprising:

housing means having a pair of spaced apart plates defining a primary transport passage therebetween having an inlet and an outlet, primary drive means for transporting a ticket through said passage between the inlet and the outlet, and diverter means including a pair of spaced apart curved plates defining a capture passage therebetween intersecting said primary transport passage, and a diverter plate extending from said capture passage into said transport passage for intercepting and diverting a ticket passing in a predetermined direction in said primary transport passage from said primary transport passage into said capture passage.

2. The diverter unit of claim 1 wherein said capture passage intersects said transport passage with an opening extending generally toward the outlet of said transport passage, and said diverter plate is operative to divert tickets passing from said outlet toward the inlet of said transport passage.

3. The diverter unit of claim 2 wherein said diverter plate comprises a leaf spring curved in an arc forming an extension of said capture passage and extending into said transport passage toward the outlet.

4. The diverter unit of claim 3 wherein said primary transport passage extends generally horizontally and said capture passage includes a generally vertically extending portion and a curved portion extending from said vertical portion to intersection of said transport passage substantially tangentially thereto.

5. The diverter unit of claim 4 wherein said primary drive means includes a pair of opposed rollers extending into engagement within said transport passage, diverter drive means including a pair of opposed rollers extending into engagement in said capture passage, and reversible drive means drivingly connected to said primary drive means and said diverter drive means.

6. The diverter unit of claim 5 wherein said primary transport passage comprises:

a lower plate having a channel therein, an upper plate detachably mounted above said channel on said lower plate for defining said transport passage.

7. The diverter unit of claim 5 wherein said housing means includes a base mounting plate and an end cover plate spaced from said base mounting plate, and said drive means includes a drive shaft extending between and mounted in said plates.

8. The diverter unit of claim 7, wherein said lower plate is secured directly to said end plates and said upper plate is detachably secured to said lower plate.

9. The diverter unit of claim 7 wherein said unit is disposed in a system between a first unit and a second unit for receiving a ticket from said first unit and transporting it to said second unit and operative to receive a ticket from said second unit and diverting it via said capture passage to a receptacle or the like.

10. The diverter unit of claim 2 wherein said diverter plate is a leaf spring deflected from first position to permit a ticket to pass in one direction in said transport passage and normally biased to said first position to intercept and divert a ticket passing in the other direction in said passage.

11. The diverter unit of claim 5 wherein said capture passage includes sensing means for sensing a ticket therein.

12. The diverter unit of claim 5 wherein said drive means is reversible.

* * * * *

UNITED STATES PATENT AND TRADEMARK OFFICE

CERTIFICATE OF CORRECTION

PATENT NO. : 4,416,378

DATED : November 22, 1983

INVENTOR(S) : Gregory E. Miller

It is certified that error appears in the above-identified patent and that said Letters Patent are hereby corrected as shown below:

On the title page:

Immediately below the inventor's name and address data, insert --Assignee: Cubic Western Data, San Diego, California--

Signed and Sealed this

*Nineteenth* Day of *March 1985*

[SEAL]

*Attest:*

DONALD J. QUIGG

*Attesting Officer* *Acting Commissioner of Patents and Trademarks*